United States Patent [19]

Iwao

[11] 4,179,825

[45] Dec. 25, 1979

[54] APPARATUS FOR TEACHING NUMERICAL CONCEPTS

[75] Inventor: Noriaki Iwao, Tokyo, Japan

[73] Assignee: Tomy Kogyo Co., Inc., Tokyo, Japan

[21] Appl. No.: 842,111

[22] Filed: Oct. 14, 1977

[30] Foreign Application Priority Data

Oct. 15, 1976 [JP] Japan ..... 51-139171[U]

[51] Int. Cl.[2] ..... G09B 19/02

[52] U.S. Cl. ..... 35/32

[58] Field of Search ..... 35/9 R, 9 A, 30, 31 R, 35/31 A, 31 C, 32, 39; 40/505

[56] References Cited

U.S. PATENT DOCUMENTS

| | | | |
|---|---|---|---|
| 2,643,467 | 6/1953 | Goodwin | 35/31 A |
| 2,965,980 | 12/1960 | Day | 35/31 A |
| 3,011,270 | 12/1961 | Hosbach | 35/31 A |
| 3,075,310 | 1/1963 | Culver et al. | 40/505 |
| 3,087,258 | 4/1963 | Anderson | 35/31 R |
| 3,504,449 | 4/1970 | Kobler et al. | 35/31 R |
| 3,696,526 | 10/1972 | Roeder et al. | 35/31 C X |
| 3,758,961 | 9/1973 | Matsumoto | 35/9 A |
| 3,924,339 | 12/1975 | Wilson et al. | 35/9 A X |
| 3,932,948 | 1/1976 | Goddard et al. | 35/9 A |
| 4,015,346 | 4/1977 | Ogasawara | 35/39 |

FOREIGN PATENT DOCUMENTS 1268519 3/1972 United Kingdom .

*Primary Examiner*—William H. Grieb
*Attorney, Agent, or Firm*—Edward D. O'Brian

[57] ABSTRACT

A teaching apparatus for use in teaching numerical concepts can be constructed so as to utilize first and second display members which are movably mounted within a housing so that each of the members is capable of being moved from a first position to a series of successive positions. The housing is constructed so that as the display members are so moved portions of them can be viewed from the exterior of the housing. An advancing structure is provided within the housing for concurrently moving the display members from their first positions to the successive positions. First and second return structures are provided for causing the return of the display members to their first locations after they have been moved to any of the successive positions. A part may be mounted on the housing and connected to the advancing structure so that each time the advancing structure is actuated the part is moved from and then back into an initial position.

15 Claims, 6 Drawing Figures

APPARATUS FOR TEACHING NUMERICAL CONCEPTS

BACKGROUND OF THE INVENTION

The invention set forth in this specification pertains to a new and improved apparatus for teaching numerical concepts.

In the past a large number of different devices have been designed and utilized for the purpose of teaching comparatively young children numerical concepts such as are involved in common counting operations. It is not considered that the present invention is of such a character that an understanding of it requires a detailed discussion of such prior art devices. In general such prior art devices are considered undesirable for one or more of a series of different reasons.

Many of such prior art devices are undesirable from an economic standpoint. In short, many such devices are too expensive to be widely utilized. Many of such prior art devices are considered undesirable from the point of view of mechanical reliability. Since apparatuses for teaching numerical concepts are primarily utilized by young children they must be sufficiently "rugged" so as to withstand reasonable physical abuse and they must be capable of prolonged operation without mechanical repair if they are to be successful for their intended utilization.

A significant number of such prior art devices are considered undesirable because of a factor which may be briefly referred to as "play value". It is a matter of common knowledge that the attention span of a comparatively young child is comparatively limited. If a device for teaching numerical concepts is to be satisfactorily utilized by children such a device must possess or include an action or mode of operation which will stimulate a child's interest so that in effect the child can play with such device as the device itself performs its intended function of teaching numerical concepts.

SUMMARY OF THE INVENTION

A broad objective of the present invention is to provide new and improved apparatuses for teaching numerical concepts which overcome many of the limitations and/or disadvantages of related prior art devices such as are briefly discussed in the preceding. Thus, an objective of the present invention is to provide comparatively inexpensive apparatus of the type indicated. A further objective of the invention is to provide apparatuses as noted which are reliable from a mechanical standpoint in the sense that they can withstand physical abuse to a reasonable extent and are capable of prolonged operation without mechanical breakdown.

Another generalized objective of the present invention is to provide apparatuses for teaching numerical concepts which possess significant play value to the extent that they are capable of being utilized as toys, but which nevertheless are effective for their intended teaching purposes. In this connection it is noted that the invention is directed toward relatively small sized mechanical apparatuses for the purpose noted which incorporate a number of different mechanical actions and movements within a convenient volume such that an apparatus of the invention is of a reasonable dimension for use as a toy.

In accordance with this invention the noted objectives are achieved by providing a teaching apparatus for use in teaching numerical concepts which comprises: a housing having an interior and first and second display locations visible from the exterior of the housing, a first display member, a first mounting means movably supporting said first display member so that it can be moved relative to said first display location from a first position to a series of successive positions visible from the exterior of said housing, a second display member, a second mounting means movably supporting said second display member so that it can be moved relative to said second display location from a first position to a series of successive positions visible from the exterior of said housing, advancing means for concurrently moving said display members from said first positions to said successive positions, a return means for causing the concurrent return of said first and second display members from any of said successive positions to said first positions.

BRIEF DESCRIPTION OF THE DRAWINGS

Because of the nature of this invention and the fact that a summary such as the preceding cannot be expected to specifically indicate many details and features of the invention, this invention is best more fully described with reference to the accompanying drawings in which.

Figure 1:
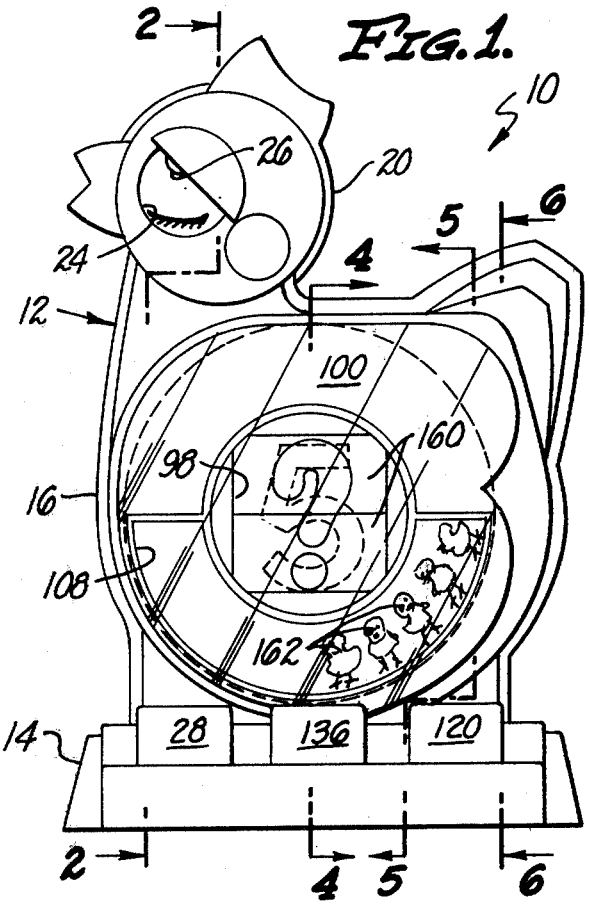
FIG. 1 is a front elevational view of a presently preferred embodiment or form of an apparatus in accordance with this invention.
Figure 2:
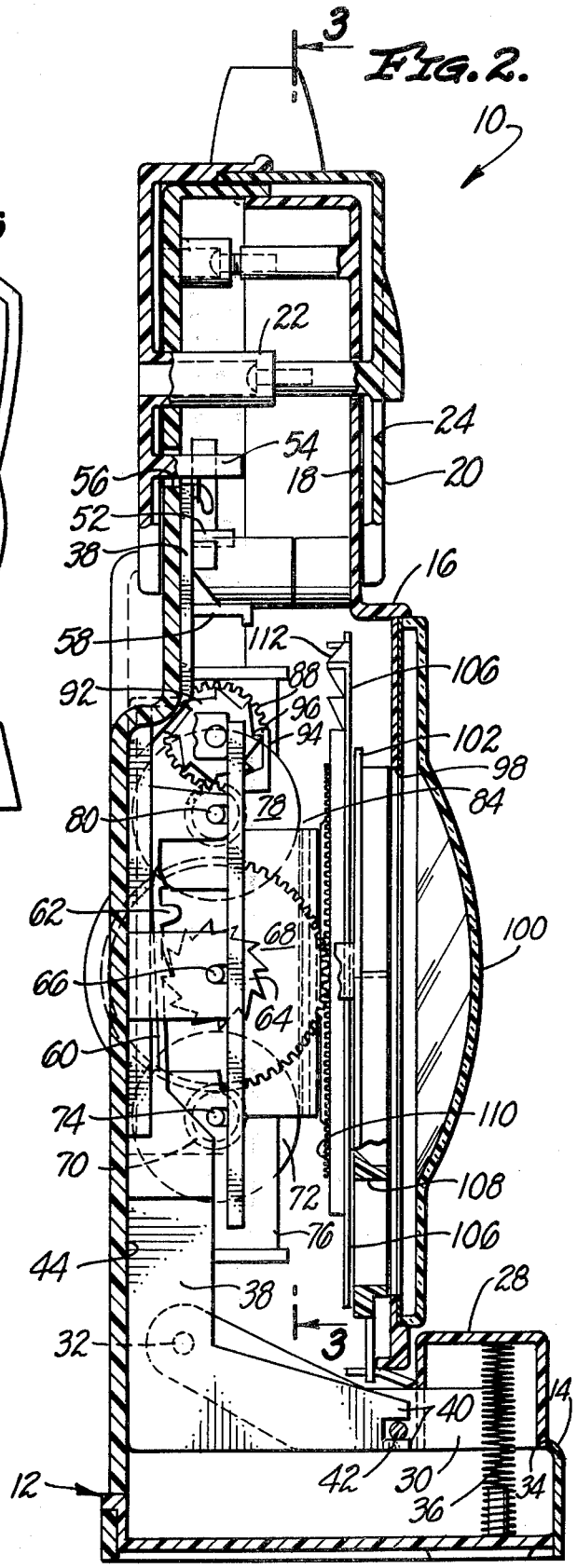
FIG. 2 is a cross-sectional view at an enlarged scale taken at line 2—2 of FIG. 1.
Figure 3:
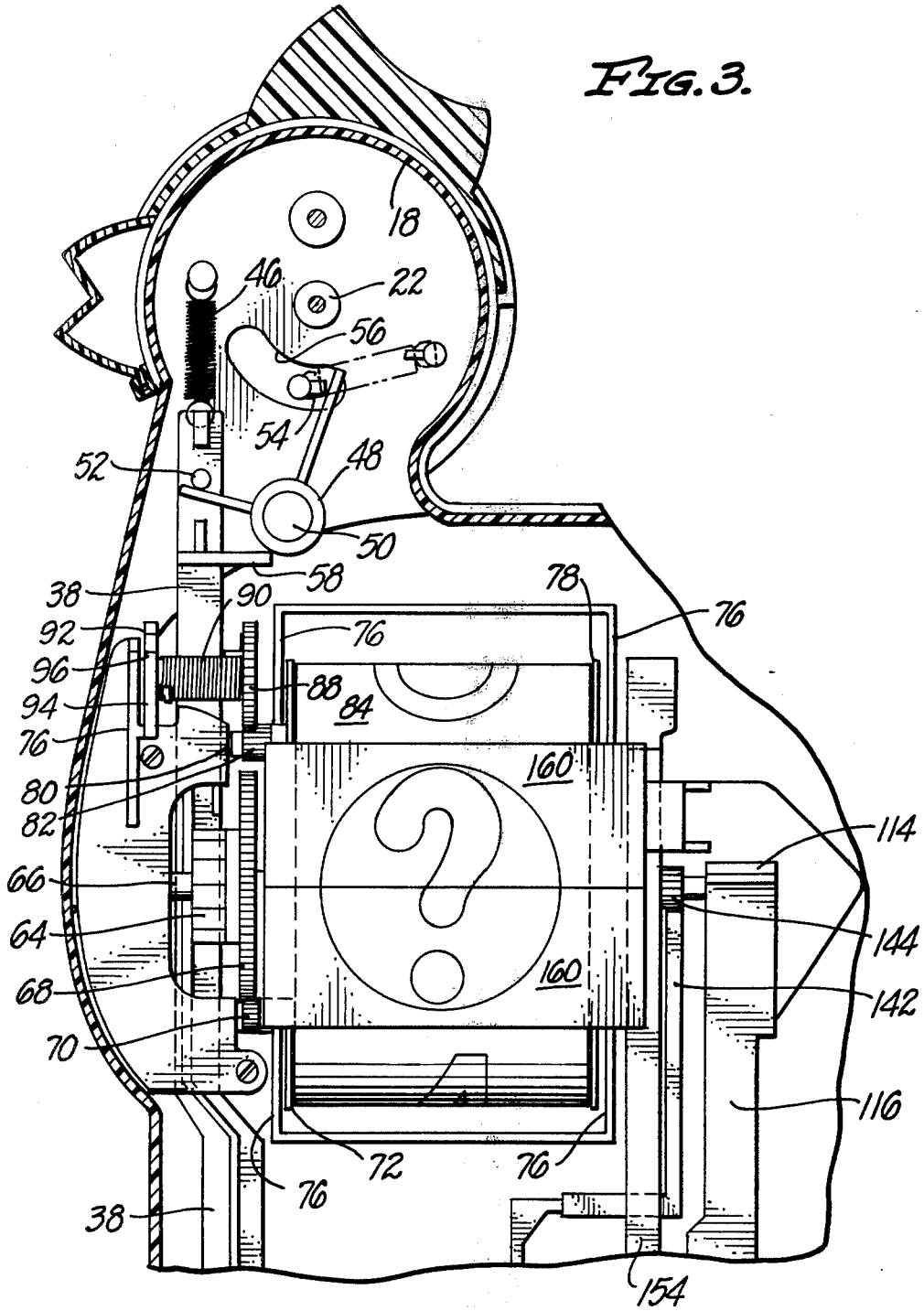
FIG. 3 is a cross-sectional view taken at line 3—3 of FIG. 2.
Figures 4, 5, 6:
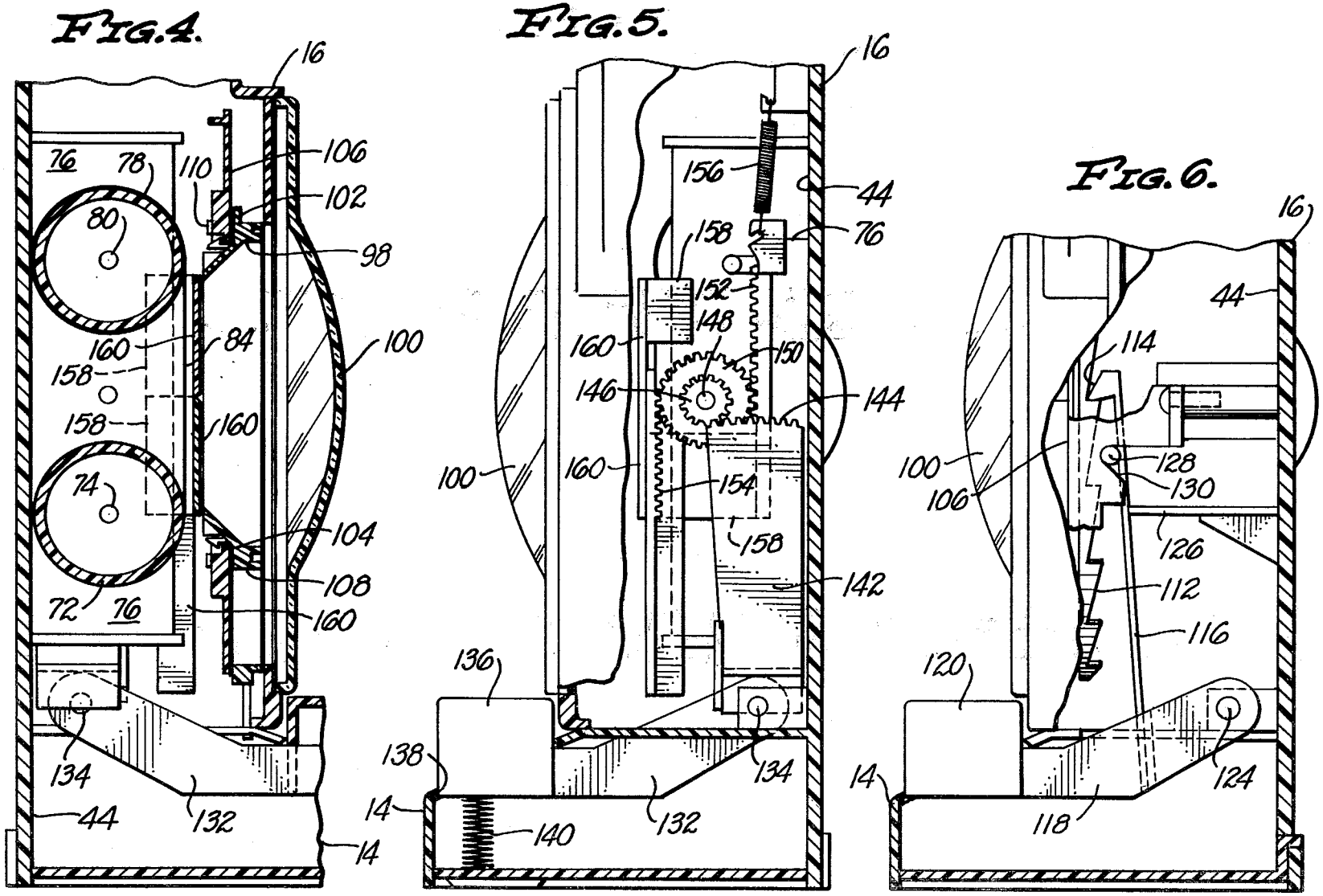
FIG. 4 is a partial cross-sectional view at an enlarged scale taken at line 4—4 of FIG. 1.
FIG. 5 is a partial cross-sectional view at an enlarged scale taken at line 5—5 of FIG. 1.
FIG. 6 is a partial cross-sectional view at an enlarged scale taken at line 6—6 of FIG. 1.

The precise apparatus illustrated embodies certain operative concepts or principles as are set forth and defined in the appended claims forming a part of this specification. Through the use of routine design or engineering skill in the toy field these operative concepts may be easily embodied within a wide variety of somewhat differently appearing and somewhat differently constructed apparatuses for teaching numerical concepts. For this reason the invention is not to be considered as being limited to the precise apparatus illustrated in the drawings.

DETAILED DESCRIPTION

The apparatus 10 illustrated includes a housing 12 shaped so as to include a base section 14 supporting a more or less simulated chicken body section 16 having what may be referred to as an "internal" head section 18 which supports a simulated head covering 20. This head covering 20 is mounted upon a shaft 22 which extends through the head section 18 and is located so as to surround the head section 18 in such a manner that the head covering 20 may be rocked back and forth relative to the head section 18. During such movement an opening 24 in the head covering 20 covers and uncovers a simulated eye 26 on the head section 18. This gives sort of the effect simulating the chicken waking up and then closing its eyes.

Within the apparatus 10 this effect is coordinated with the depression of an actuator button 28 on a lever 30. The lever 30 is mounted within the housing 12 on pivots 32 so that the button 28 extends outwardly through an opening 34 in the base 14. A small coil spring 36 is employed to bias the lever 30 in an upward location.

This lever 30 is used to move an elongated actuating slide 38 within the interior of the housing 12. The slide 38 is connected to the lever 30 by means of two yolks 40 fitting over the extremities (not separately numbered) of a pin 42 mounted on the lever 30. This slide 38 fits against the back surface 44 of the housing 12 between various structural parts as hereinafter described so as to terminate adjacent to the head section 18. A small coil spring 46 is connected between the slide 38 and the interior (not separately numbered) of the head section 18 for the purpose of normally biasing or holding the slide 38 in an upward position.

A bell crank lever 48 is mounted on a pivot 50 within the housing 12 so that a projection 52 on the slide 38 will rotate the bell crank lever 48 as the button 28 is depressed. The rotation of this bell crank 48 causes it to act upon a pin 54 extending from the head covering 20 through an arcuate slot 56 in the head section 18. Thus, when the button 28 is depressed motion will be transmitted through the slide 38 and the bell crank 48 to the pin 54 and thence to the head covering 20 in order to rotate this head covering 20 relative to the head section 18 so as to give the effect of the complete head (not separately numbered) of a simulated chicken rocking back and forth with the eye 26 opening and closing.

The weight distribution of the material within the head covering 20 is such that the head covering 20 will automatically rotate back to its initial position after the button 28 has been actuated so as to move it. If desired a more positive mechanical return (not shown) of a conventional type such as a spring can be used for this purpose. The slide 38 may be constructed so as to include an extending projection 58 which is adapted to engage the bell crank 48 so as to limit the upward movement of this slide 38. It is not considered that this expedient is mandatory within the apparatus 10.

The slide 38 also includes an elongated resilient arm 60 which extends from it generally parallel to the length of this slide 38. This resilient arm 60 supports a pawl 62 which is adapted to be utilized in actuating a ratchet wheel 64 each time the slide 38 is moved downwardly through the depression of the button 28. The arm 60 is the functional equivalent of a pivotally mounted arm (not shown) mounted on the slide 38 and biased by a spring (not shown) toward the ratchet wheel 64.

This ratchet wheel 64 is mounted upon a shaft 66 which in turn is rotatably mounted within the housing 12; it is rotated a limited amount each time the slide 38 is depressed. The ratchet wheel 64 is integral with a conventional spur gear 68. This spur gear 68 meshes with a small pinion gear 70 mounted on so as to form a part of an elongated drum or spool 72. The spool 72 includes a centrally located shaft 74 mounted on internal walls 76 within the housing 12 in such a manner that it can be rotated.

The apparatus 10 also includes another spool 78 corresponding to the spool 72. This spool 78 also includes a shaft 80 mounted on the walls 76 and a pinion gear 82 mounted on the shaft 80. It is to be noted that the two spools 72 and 78 are located so that the shafts 74 and 80 are parallel. These two spools 72 and 78 are used to support a belt 84 containing a series of numbers starting with zero in such a manner that during the operation of the apparatus 10 the belt 84 may be first wound on the spool 72 and then rewound on the spool 78.

Such rewinding is accomplished utilizing a spring mechanism (not separately numbered) consisting of a small jack shaft 86 mounted upon walls 76 and carrying a pinion 88 which meshes with the pinion 82. A coil spring 90 is located loosely around the shaft 86 so as to have one of its ends (not separately numbered) attached to the pinion 88. The other of the ends (not separately numbered) of this spring 90 is secured to a cog wheel 92 located on the shaft 86 so as to be freely rotatable with respect to the shaft 86.

A resilient arm 94 carrying a pawl 96 is located on a wall 76 for the purpose of engaging the ratchet wheel 92 so as to prevent rotation of this ratchet wheel 92. The arm 94 and the pawl 96 reasonably correspond to the arm 60 and the pawl 62 previously described. With the apparatus 10 it is possible to adjust the spring tension on the spring 90 by varying the position of the ratchet wheel 92 with respect to the pawl 62 so as to obtain a desired speed or rewinding of the belt 84 on the spool 78 during the use of the apparatus 10.

This belt 84 is adapted to traverse an area (not separately numbered) within the housing 12 immediately in back of a viewing opening 98 in the housing 12 serving as a display location. Normally this viewing opening 98 is covered by means of a transparent, protective cover plate 100. For convenience of construction the viewing opening 98 is preferably formed in a support plate 102 forming a part of the housing 12. This support plate 102 is also formed with a bearing surface 104 which rotatably supports a display ring 106 so that this ring can rotate generally around the opening 98.

An elongated arcuate opening 108 is formed in the support plate 102 so that successive portions of the display ring 106 may be viewed as the display ring 106 is rotated through the operation of the apparatus 10. This opening 108 also serves as a display location; it is also covered by the cover plate 100. Rotation of the ring 106 is caused by a crown gear 110 formed as part of the display ring 106 meshing with the spur gear 68.

With this structure, the ring 106 is rotated in synchronism with the rotation of the spool 72 since both the ring 106 and the spool 72 are driven by the same spur gear 68. As a consequence of this the ring 106 will be rotated an incremental amount corresponding to the amount that the belt 84 is drawn up on to the spool 72 each time the button 28 is actuated. In order to prevent reverse rotation—i.e., rotation opposite to that caused by actuation of the button 28—the display ring 106 is formed so as to include a plurality of holding ratchet teeth 112.

These ratchet teeth 112 mate with a pawl 114 formed on an elongated resilient arm 116. This arm 116 is directly secured to a lever 118 corresponding to the previously described lever 30. This lever 118 includes another button 120 extending outwardly from the base 14 of the housing 12 through an opening 122. It is pivotally mounted on the housing 12 by means of pivots 124. The arm 116 also bears against a wall 126 serving as a fulcrum for the purpose of controlling its position so that the arm 116 will flex sufficiently to accommodate rotation of the display ring 106 as caused by the mechanism as described in the preceding.

Each time the button 120 is pushed downwardly a projection 128 on it will be forced against a bearing surface or notch 130 on the support plate 102 so that the flexure of the arm 116 will cause the pawl 114 to be spaced from the ratchet teeth 112. This will, of course, release the display ring 106. As this occurs, the entire mechanical system described in the preceding will rotate in the reverse of the manner caused by actuation of the button 28 as a result of the action of the spring 90. This spring 90 is "wound" as the button 28 is actuated and the release of the pawl 114 in effect serves to permit the release of energy stored within the spring 90.

The apparatus 10 also includes another lever 132 reasonably corresponding to the levers 30 and 118 described in the preceding. This lever 132 is mounted by means of pivots 134 in the housing 12 so as to support a button 136 in such a manner that the button 136 extends outwardly of the base 14 through another opening 138. A small coil spring 140 is used to bias the lever 132 to an upward position as indicated.

This lever 132 carries an elongated upstanding arm 142 carrying a gear sector 144. This gear sector 144 is adapted to mate with a small spur gear 146 located upon a shaft 148. This shaft 148 is mounted upon walls 76. A spur gear 150 is secured to the gear 146 about the shaft 148 in such a position as to mate with two different elongated gear racks 152 and 154. These racks 152 and 154 are located so as to slide or move along walls 76 within the housing 12 as the button 136 is actuated. The rack 152 is normally biased to an upward position by means of a small coil spring 156.

The spring 156 serves to return the gear racks 152 and 154 and various associated parts as hereinafter indicated to what may be regarded as an initial or closed position each time the button 136 is depressed and then released. These racks 152 and 154 are connected by means of walls 158 to two coplanar walls 160 serving as a shutter within the apparatus 10. These walls 160 extend between the belt 84 and the opening 98 and serve to normally close off the belt 84 from view. When the button 136 is depressed the various parts described in the preceding act so as to move the walls 160 so that a part of the belt 84 is visible.

It is believed that the operation of the apparatus 10 will only be apparent to a limited degree from a consideration of the aforegoing. As this apparatus 10 is at a normal "at rest" or "not in use" state, the walls 160 will abut with one another and the display ring 106 will be located so that various indicia 162 such as, for example, indicia corresponding to individual chickens will be in back of the support plate 102 and will not be visible through the arcuate opening 108. Also in this normal "non-use" condition the belt 84 will be located relative to the spools 72 and 78 so that a large zero imprinted upon the belt 84 is immediately behind the walls 160. Further, the head covering 20 will be located so that the simulated eye 26 is covered.

If desired, at this point the button 136 may be pushed downwardly so as to move the walls 160 in such a manner that the number zero on the belt 84 may be viewed. This will correspond to none of the indicia 162 being visible through the opening 108. Normally a child will commence use of the apparatus 10 by pushing down on the button 28. Through the use of the mechanical components described in the preceding this will serve to advance the belt 84 on to the spool 72 so that the numeral "1" is located immediately behind the walls 160. It will also advance or rotate the display ring 106 to a sufficient extent so that one of the indicia 162 is visible through the opening 108.

Such actuation will also concurrently result in movement of the head covering 20 so that the eye 26 is visible through the opening 24. When the button 28 is released after having been depressed so as to cause this series of concurrent actions or movements the head covering 20 will return as a result of the action of gravity to its initial position while the belt 84 and the display ring 106 will be held against movement through the action of the pawl 114 against the ratchet teeth 112. At this point the user may depress the button 136 in order to move the walls 160 so as to see the number "1" displayed. At the same time a single one of the indicia 162 is visible. Upon release of the button 136 the walls 160 will move together.

A user may continue in this manner so as to actuate the button 28 any number of times desired in order to display through the opening 128 a number of the indicia 162 corresponding to the number of times that the button 28 is depressed. At any time the button 136 may be depressed so as to display on the belt 84 through the opening 98 the symbol of the number corresponding to the number of the indicia 162 capable of being viewed through the opening 108. The head covering 20 will of course move back and forth a number of times corresponding to the number capable of being viewed through the opening 108.

Because of physical limitations it is presently considered preferable to limit any such number capable of being tallied as the apparatus 10 is used to the number "10". When any number (other than zero) is indicated by the number of indicia 162 visible through the opening 108 or on the portion of the belt 84 which can be viewed through the opening 98 the apparatus 10 may be "reset" by actuating the button 120. When the apparatus 10 is "reset" the belt 84 will return to a position in which a zero is behind the opening 98 and the ring 106 will return to a position in which none of the indicia 162 are visible.

I claim:

1. A teaching apparatus for use in teaching numerical concepts which comprises:

a housing having an interior and first and second display locations visible from the exterior of said housing, a first display member having a series of indicia thereon, a first mounting means movably supporting said first display member so that it can be moved relative to said first display location from a first position to a series of successive positions in each of which only one of said indicia on said first display member is visible from the exterior of said housing, a second display member having a series of indicia thereon, a second mounting means movably supporting said second display member so that it can be moved relative to said second display location from a first position to a series of successive positions in each of which a number of said indicia corresponding to the number of times said second display member has been moved is visible from the exterior of said housing, advancing means for concurrently moving said display members from said first positions to said successive positions, said advancing means including a lever pivotally mounted on said housing, an actuator button on said lever, said actuator button extending outwardly from the exterior of said housing and mechanical linkage means connecting said lever with said display members, a return means for causing the concurrent return of said first and second display members from any of said successive positions to said first positions.

2. An apparatus as claimed in claim 1 including:

shutter means normally covering one of said display locations, said shutter means being capable of being opened so as to permit viewing of one of said display members through the viewing location normally covered by said shutter means.

3. An apparatus as claimed in claim 1 including:

shutter means normally covering one of said display locations, said shutter means being capable of being opened so as to permit viewing of one of said display members through the viewing location normally covered by said shutter means, movable means mounted on said housing visible from the exterior of said housing, mechanical means connecting said movable means with said advancing means for moving said movable means from an initial position and returning said movable means to said initial position each time said advancing means is operated.

4. An apparatus as claimed in claim 1 wherein:

said first mounting means comprises a pair of rotatably mounted spools, said first display member comprises a belt mounted on said spools and extending between said spools, said first display location comprises an opening in said housing, said belt being located so that a portion of said belt is visible through said opening, 5. An apparatus as claimed in claim 4 wherein:

said belt is provided with a series of indicia indicating numerical concepts, successive of said indicia being visible through said opening as said belt is moved relative to said spools from said first position to said series of successive positions.

6. An apparatus as claimed in claim 5 wherein:

said advancing means include ratchet and pawl means for incrementally winding said belt from one of said spools to the other of said spools in amounts corresponding to the amounts necessary to move said belt so that successive of said indicia are visible through said opening.

7. An apparatus as claimed in claim 1 wherein:

said second display member comprises a ring, said second mounting means comprises a bearing for rotatably mounting said ring so that it is capable of being rotated about its center, said second display location comprises an opening in said housing through which a portion of said ring is visible.

8. An apparatus as claimed in claim 7 wherein:

said ring is provided with a series of indicia indicating numerical concepts, successive of said indicia being visible through said opening as said ring is rotated from said first position to said series of successive positions.

9. An apparatus as claimed in claim 8 wherein:

said advancing means includes gear means for incrementally rotating said ring in amounts corresponding to the amounts necessary to rotate said ring so that successive of said indicia are visible through said opening.

10. A teaching apparatus for use in teaching numerical concepts which comprises:

a housing having an interior and first and second display locations visible from the exterior of said housing, a first display member having a series of indicia thereon, a first mounting means movably supporting said first display member so that it can be moved relative to said first display location from a first position to a series of successive positions visible from the exterior of said housing, a second display member having a series of indicia thereon, a second mounting means movably supporting said second display member so that it can be moved relative to said second display location from a first position to a series of successive positions visible from the exterior of said housing, advancing means for concurrently moving said display members from said first positions to said successive positions, a return means for causing the concurrent return of said first and second display members from any of said successive positions to said first positions, movable means mounted on said housing visible from the exterior of said housing, mechanical means connecting said movable means with said advancing means for moving said movable means from an initial position and returning said movable means to said initial position each time said advancing means is operated.

11. A teaching apparatus for use in teaching numerical concepts which comprises:

a housing having an interior and first and second display locations visible from the exterior of said housing, said first and second display locations comprise first and second openings located adjacent to one another in said housing, a first display member, said first display member comprises a belt containing indicia indicating numerical concepts, a first mounting means movably supporting said first display member so that it can be moved relative to said first display location from a first position to a series of successive positions visible from the exterior of said housing, said first mounting means comprises a pair of rotatably mounted spools, said belt being attached to said spools so as to be capable of being wound between said spools so that successive of said indicia are visible through said first opening, a second display member, said second display member comprises a ring provided with a series of indicia indicating numerical concepts, a second mounting means movably supporting said second display member so that it can be moved relative to said second display location from a first position to a series of successive positions visible from the exterior of said housing, said second mounting means comprises a bearing for rotatably mounting said ring so that said ring is capable of being rotated about its center, said ring being located generally around said first opening so that successive of said indicia is visible through said second opening as said ring is rotated, advancing means for concurrently moving said display members from said first positions to said successive positions, a return means for causing the concurrent return of said first and second display members from any of said successive positions to said first positions.

12. An apparatus as claimed in claim 11 including:

shutter means for covering one of said openings, said shutter means being capable of being actuated so as to uncover the opening normally covered by said shutter means.

13. An apparatus as claimed in claim 12 wherein:

said advancing means includes ratchet and pawl means for incrementally rotating one of said spools so as to wind said belt on said one of said spools and for incrementally rotating said ring, said advancing means also including mechanical means connecting said ratchet and pawl means to said one of said spools and to said ring.

14. An apparatus as claimed in claim 13 wherein:

said rewinding means includes a rewind spring connected to the other of said spools so that energy is stored within said rewind spring as said belt is wound on said one of said spools, said rewind means also including ratchet and pawl means for holding said display members so that they cannot be moved through the operation of said rewind spring means, said rewind means also including release means for disengaging said ratchet and pawl means of said rewind means.

15. An apparatus as claimed in claim 14 including:

movable means mounted on said housing visible from the exterior of said housing, mechanical means connecting said movable means with said advancing means for moving said movable means from an initial position and returning said movable means to said initial position each time said advancing means is operated.

* * * * *